US008191605B2

(12) United States Patent
Kwak

(10) Patent No.: US 8,191,605 B2
(45) Date of Patent: Jun. 5, 2012

(54) ONE CORD BLIND

(76) Inventor: Jae-Suk Kwak, Gyeonggi-do (KR)

( * ) Notice: Subject to any disclaimer, the term of this patent is extended or adjusted under 35 U.S.C. 154(b) by 336 days.

(21) Appl. No.: 12/480,371

(22) Filed: Jun. 8, 2009

(65) Prior Publication Data

US 2009/0308547 A1 Dec. 17, 2009

(30) Foreign Application Priority Data

Jun. 16, 2008 (KR) ..... 10-2008-0056175

(51) Int. Cl.
*A47G 5/02* (2006.01)

(52) U.S. Cl. ..... 160/319; 160/193

(58) Field of Classification Search ..... 160/319, 160/329, 170, 84.04, 84.05, 168.1 R, 178.1 R, 160/173 R; 242/394, 395, 564.2; 192/46, 192/41 S See application file for complete search history.

(56) References Cited

U.S. PATENT DOCUMENTS

| | | | | |
|---|---|---|---|---|
| 5,890,529 | A * | 4/1999 | Haarer | 160/319 |
| 6,129,131 | A * | 10/2000 | Colson | 160/84.02 |
| 6,529,323 | B2 * | 3/2003 | Okumura | 359/461 |
| 7,128,126 | B2 * | 10/2006 | Smith et al. | 160/319 |
| 7,578,334 | B2 * | 8/2009 | Smith et al. | 160/319 |
| 7,665,507 | B2 * | 2/2010 | Naoki | 160/308 |
| 2009/0308547 | A1 * | 12/2009 | Kwak | 160/368.1 |
| 2010/0018656 | A1 * | 1/2010 | Fujita et al. | 160/319 |

* cited by examiner

*Primary Examiner* — Blair M. Johnson
(74) *Attorney, Agent, or Firm* — Levine & Mandelbaum

(57) ABSTRACT

Disclosed is a one cord blind that has a simplified structure enabling it to be easily manufactured, prevents a safety accident by not using a ball chain, makes an interior design neat and enables a roll screen to move upward and downward by a rotating cord or hands, so that the upward and downward operations can be easily made.

1 Claim, 11 Drawing Sheets

ONE CORD BLIND

CROSS-REFERENCE TO RELATED APPLICATIONS

This application claims all benefits of Korean Patent Application No. 10-2008-0056175 filed on Jun. 16, 2008 in the Korean Intellectual Property Office, the disclosures of which are incorporated herein by reference.

BACKGROUND OF THE INVENTION

1. Field of the Invention

The present invention relates to a one cord blind, and more particularly, to a one cord blind having a simpler structure enabling it to be easily manufactured and capable of preventing a safety accident by not using a ball chain and making an interior design neat.

2. Description of the Prior Art

In general, a roll screen blind is used in an office, home, restaurant and the like, in place of curtain. When a ball chain of a sprocket mounted to one side of a bracket is pulled in one direction, screen made of fabric or synthetic resin is moved downward while it is unwound from a winding pipe by elastic force of a spring. Then, when the screen is fixed at a predetermined location, it screens the light coming through a window and the like.

As shown in FIG. 1, according to the conventional roll screen blind 10, a pivot member 5 and a deceleration member 8 are mounted at both brackets 9 and a winding pipe having the screen wound thereon is engaged on the exterior surfaces thereof.

In the pivot member 5, a connection shaft 3 having a pivot element 2 is mounted at the front of a pivot body 1 and a spring 5 is engaged on the connection shaft 3. Both ends of the spring 4 are fixed one sides of the pivot body 1 and the pivot element 2, respectively. The pivot element 2 enables the connection shaft 3 to move right and left by the elastic force of the spring 4.

In the deceleration member 8, a decelerator 6 is provided at the front of the pivot body 1 having an adjustor and a fixing shaft 7 having a deceleration nut 7*a* is connected at the front of the decelerator.

The winding pipe having the screen wounded thereon is engaged on the exterior surfaces of the both pivot bodies 1. The brackets 9 are fixed on the window frame or glass wall frame by the nuts and the like.

With the above roll screen blind, when the ball chain mounted at the sprocket is pulled in one direction so as to operate the screen upward or downward, the screen is moved downward to block the light. When the ball chain is pulled in another direction, the screen is moved upward.

According to the above roll screen blind, the ball chain consists of two chains connected to each other, rather than one chain, so that it is not convenient for a user to operate the screen downward or upward.

In addition, the ball chain is sometimes entangled, thereby spoiling the appearance of the blind. Further, only after straightening the entangled chain, the blind can be used.

Furthermore, in order to move the screen downward, the user should continuously pull the ball chain in one direction.

SUMMARY OF THE INVENTION

Accordingly, the present invention has been made to solve the above problems. An object of the invention is to provide a one cord blind having a simplified structure enabling cost of manufacture to be remarkably decreased, and capable of preventing a safety accident or a chain from being entangled by not using a ball chain.

Another object of the invention is to provide a one cord blind capable of making an interior design neat by not using a ball chain consisting of two strings and enabling a user to move a roll screen upward and downward by hands or by using a knob of a rotating cord, thereby operating the blind easily and conveniently.

In order to achieve the above object, there is provided a one cord blind comprising: a fixing body consisting of a fixing plate that forms a fixing stage on one surface thereof, the fixing stage having a fixing recess with which a leaf spring is engaged, a fixing shaft at its center, which protrudes forward, and a plurality of fixing protrusions around the fixing shaft; a gear body including an inner gear inserted onto the fixing shaft, which gear symmetrically forms reinforcement steps on its inner surface and has threads on its outer surface, small gears each of which is inserted onto the respective fixing protrusions and has threads on its outer surface, the inner gear and the small gears being engaged with each other, and a fixing ring including fixing steps having inner incised grooves, which are symmetrically formed on its exterior surface, locking steps of a spring being engaged with the incised grooves; an operation plate that is screw-engaged with the outer surfaces of the small gears and has a rotating cord wound on its outer periphery, the cord having a knob formed at its lower end, and a connection recess at its front with which a rotating gear having threads at its inner and outer peripheries is engaged; an end plate that is mounted at a front surface of the operation plate, has an insertion opening at its center and prevents the gear body and the rotating cord from deviating outward; a delivery element that is inserted into the insertion opening of the end plate to contact the reinforcement steps of the inner gear and has at its center an insertion opening through which the fixing shaft is inserted, a rear part at which connection recesses, each of which has an inclined surface at one side thereof, are formed to be symmetrical, and a front part having threads; and a cover having a pivot element at its inner front, which has threads, which are engaged with the threads of the delivery element, and an insertion opening at its center.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, a preferred embodiment of the present invention will be described with reference to the accompanying drawings. In the following description of the present invention, a detailed description of known functions and configurations incorporated herein will be omitted when it may make the subject matter of the present invention rather unclear.

Figure 2:
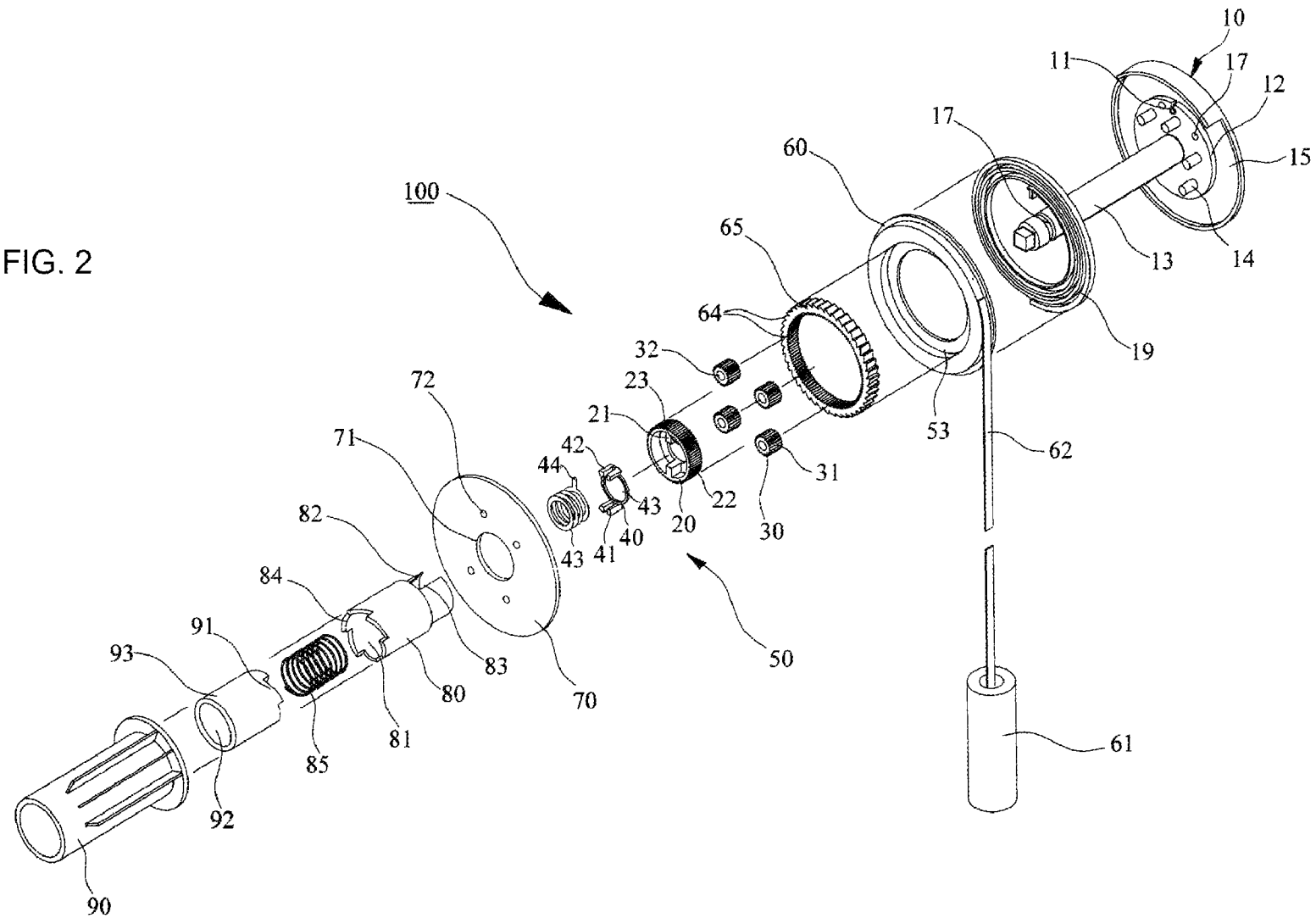
FIG. 2 is an exploded perspective view showing a structure according to an embodiment of the invention.
Figure 3:
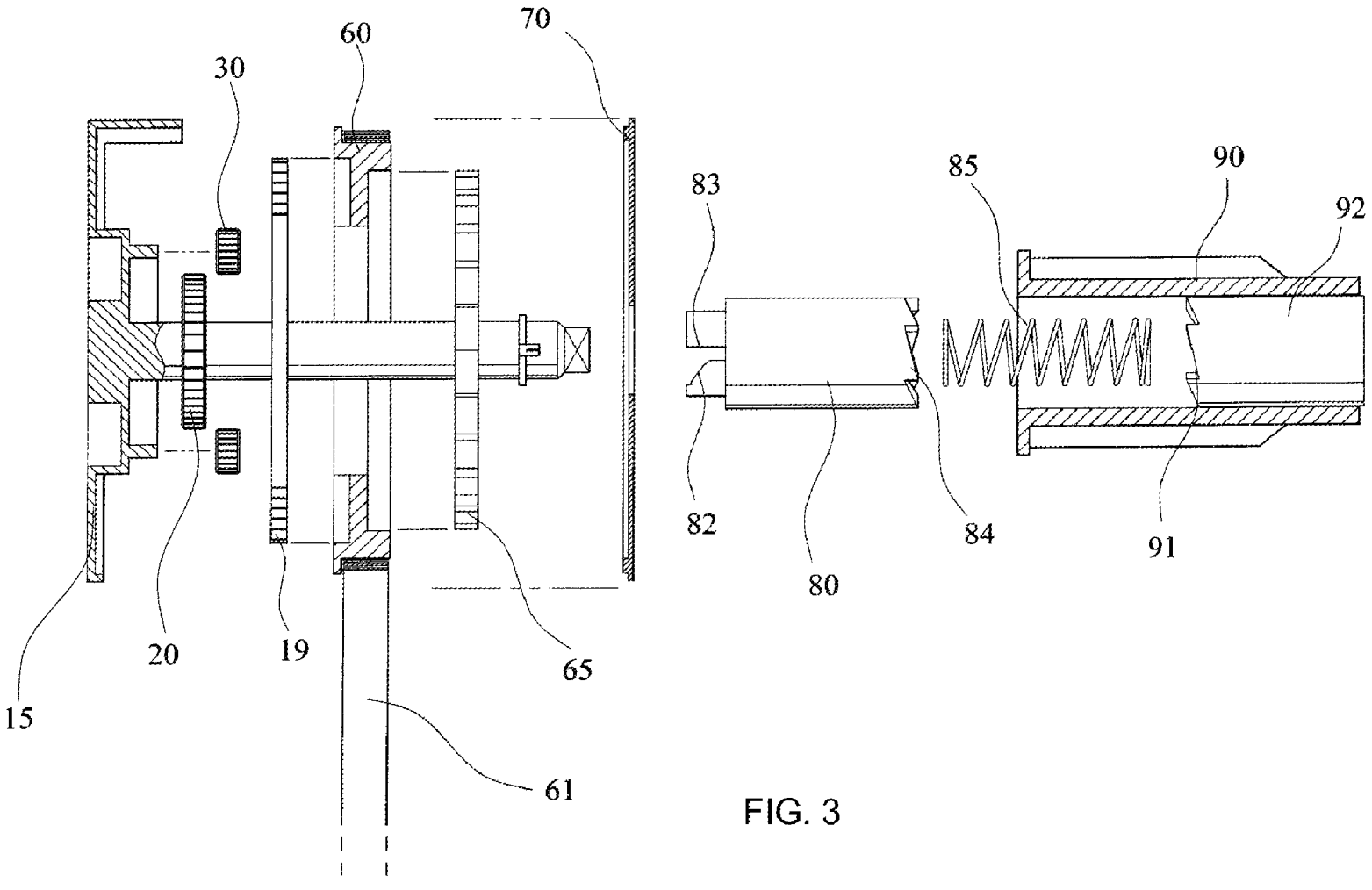
FIG. 3 is a sectional view showing a structure according to an embodiment of the invention.

FIGS. 2 and 3 show a structure of the invention, wherein a reference numeral 100 indicates a main body of a one cord blind according to an embodiment of the invention.

The main body 100 comprises a fixing body 10 consisting of a fixing plate 15 having a fixing shaft 13, a gear body 50 consisting of a plurality of gears, an operation plate 60 rotating while cooperating with the gears and including a rotating cord 62 having a knob 61 formed therewith, an end plate 70 preventing the gear body 50 and the rotating cord 62 from deviating outward, and a delivery element 80 engaging with a pivot element 93 of a sleeve 90 and fixing and releasing the sleeve 90.

The fixing body 10 consisting of the circular fixing plate 15 forms a fixing stage 12 on one surface thereof, which protrudes forward and has a fixing recess 11 with which a leaf spring 19 is engaged. The fixing shaft 13 that protrudes forward and forms a washer recess 18 at its leading end is formed on the center of the fixing body. A plurality of fixing protrusions 14 is formed on the exterior surface of the fixing stage 12.

Bolt recesses 17 are formed between the fixing protrusions 14 so that bolts can be engaged therewith.

The gear body 50 comprises the gears consisting of an inner gear 20, small gears 30 and a fixing ring 40.

The inner gear 20 forms reinforcement steps 21 on its inner surface, which are symmetrically formed to protrude forward, and threads on its outer surface. The inner gears also forms an insertion opening 23 at its center so that it can be inserted onto the fixing shaft 13.

Each of the small gears 30 has an insertion opening 32 at its center and forms threads on its outer surface.

Figure 4:
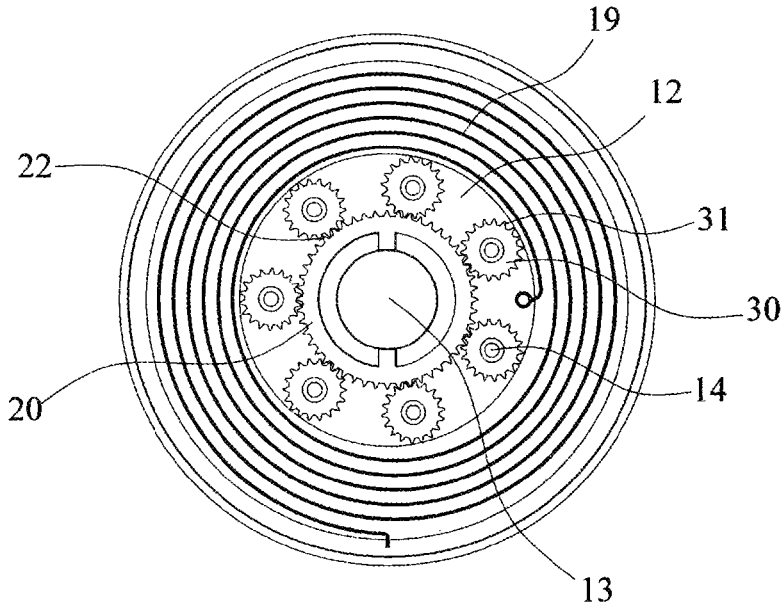
FIGS. 4 and 5 are side views showing a connected state of the invention.

As shown in FIG. 4, the inner gear 20 is closely contacted to the fixing steps 12 by inserting the insertion opening 23 of the inner gear 20 onto the exterior surface of the fixing shaft 13. The insertion openings 32 of the small gears 30 are inserted onto the fixing protrusions 14.

At this time, the threads 22 formed on the exterior surface of the inner gears 20 are engaged with the threads 31 formed on the exterior surfaces of the small gears 30, so that they are rotated at the same direction.

Then, the fixing ring 40 including fixing steps 42 having inner incised grooves 41, which are symmetrically formed on its exterior surface, is pivotably mounted on the exterior surface of the fixing shaft 13.

The incised grooves 41 of the fixing ring 40 are inserted with locking steps 44 of a spring 43, and the lower surface of the fixing step 42 is mounted to contact the one surface of the reinforcement step 21.

The operation plate 60 is wound on its outer periphery with a rotating cord 62 of one string having a knob 61 at its lower end, and has an annular groove 63 at its forward surface in which a rotating gear 65 having teeth 64 at its inner and outer peripheries is fixedly engaged.

Figure 5:
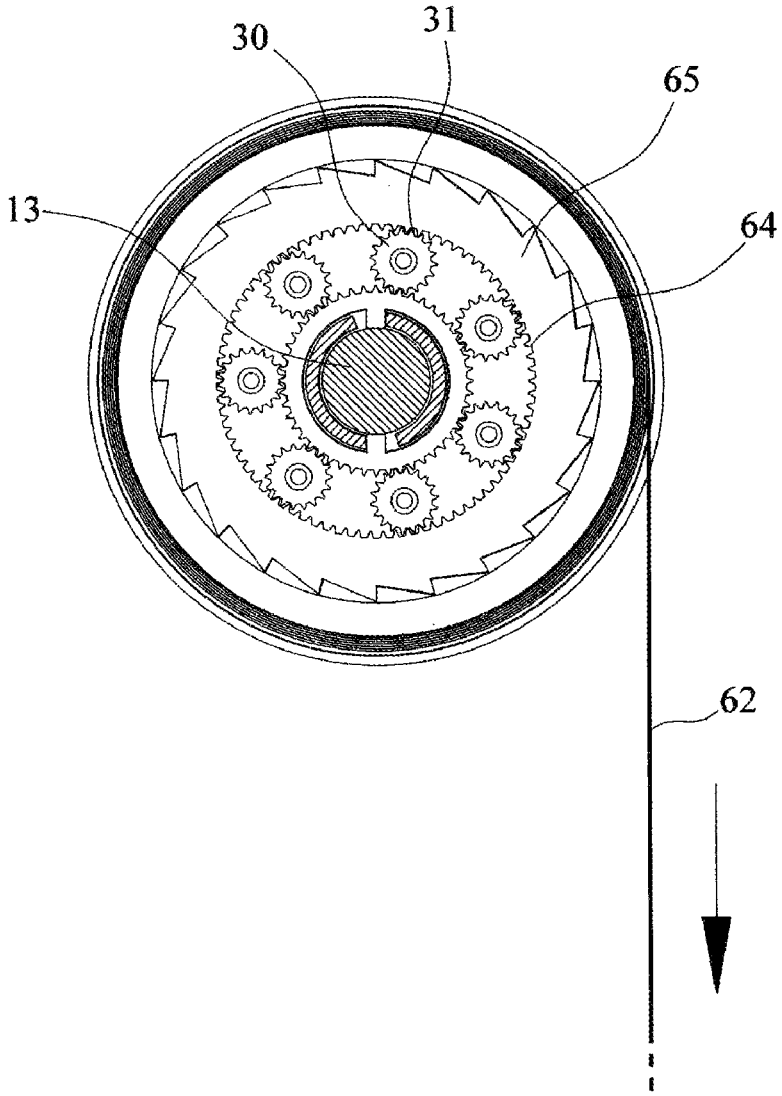

When the operation plate 60 is connected to the outer surface of the rotating gear 65, as shown in FIG. 5, the threads 64 formed on the inner surface of the rotating gear 65 are engaged with the threads 31 of the small gears 30.

The end plate 70 has an insertion opening 71 at its center and a plurality of holes 72 on its outer surface.

The insertion opening 71 of the end plate 70 is inserted onto the fixing shaft 13 so that it is contacted to the operation plate 60. At this time, the fixing protrusions 14 are engaged into the holes 72, so that the end plate 70 is fixedly mounted.

The delivery element 80 is cylindrical, and has at its center an insertion opening 81 through which the fixing shaft 13 is inserted, a rear part at which connection notches 83, each of which has an inclined edge 82 at one side thereof, are formed to be symmetrical, and a front part having teeth 84.

Figure 6:
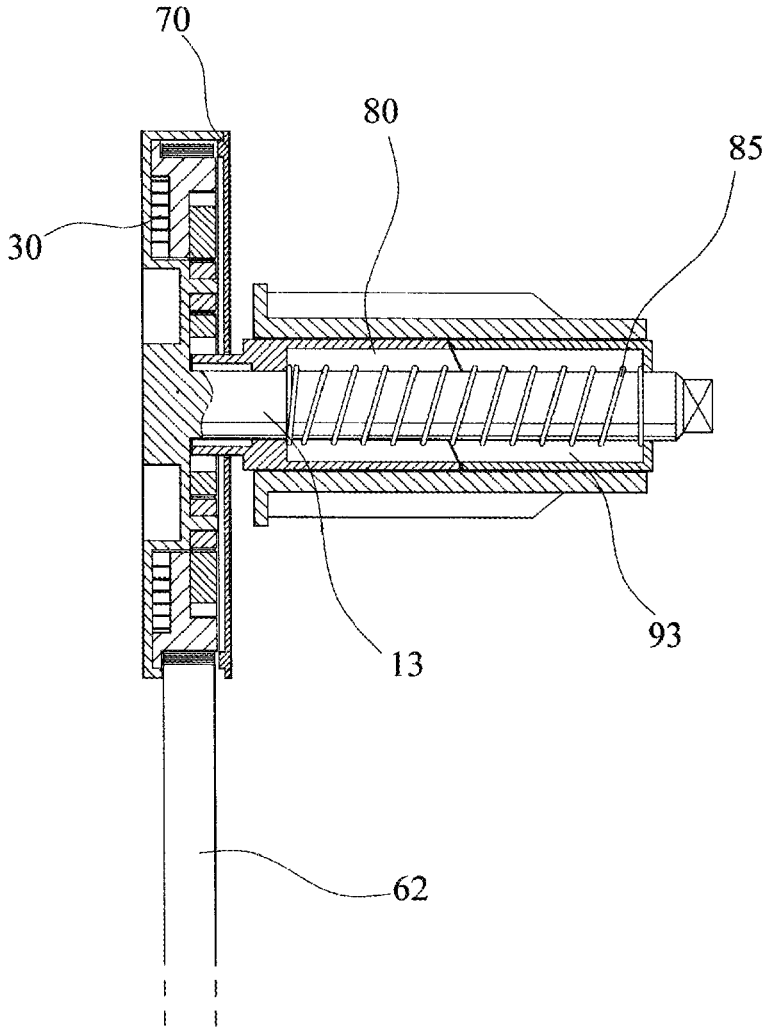
FIG. 6 is a side sectional view showing a structure according to an embodiment of the invention.
Figure 7:
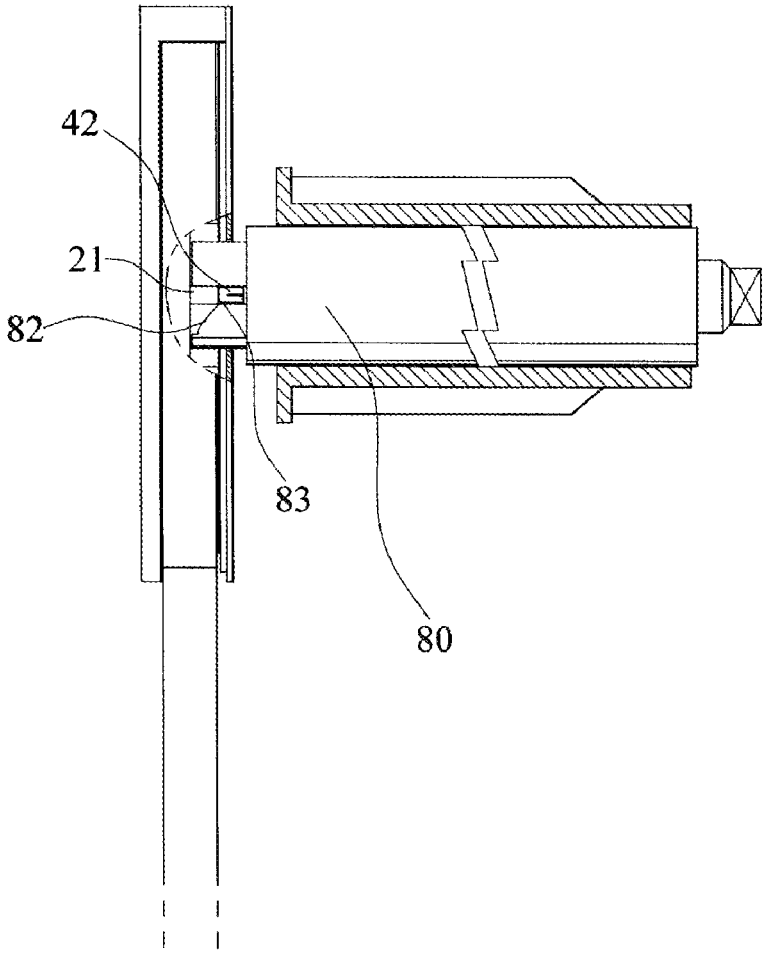
FIGS. 7 and 8 are side views showing an operating state of the invention.
Figure 8:
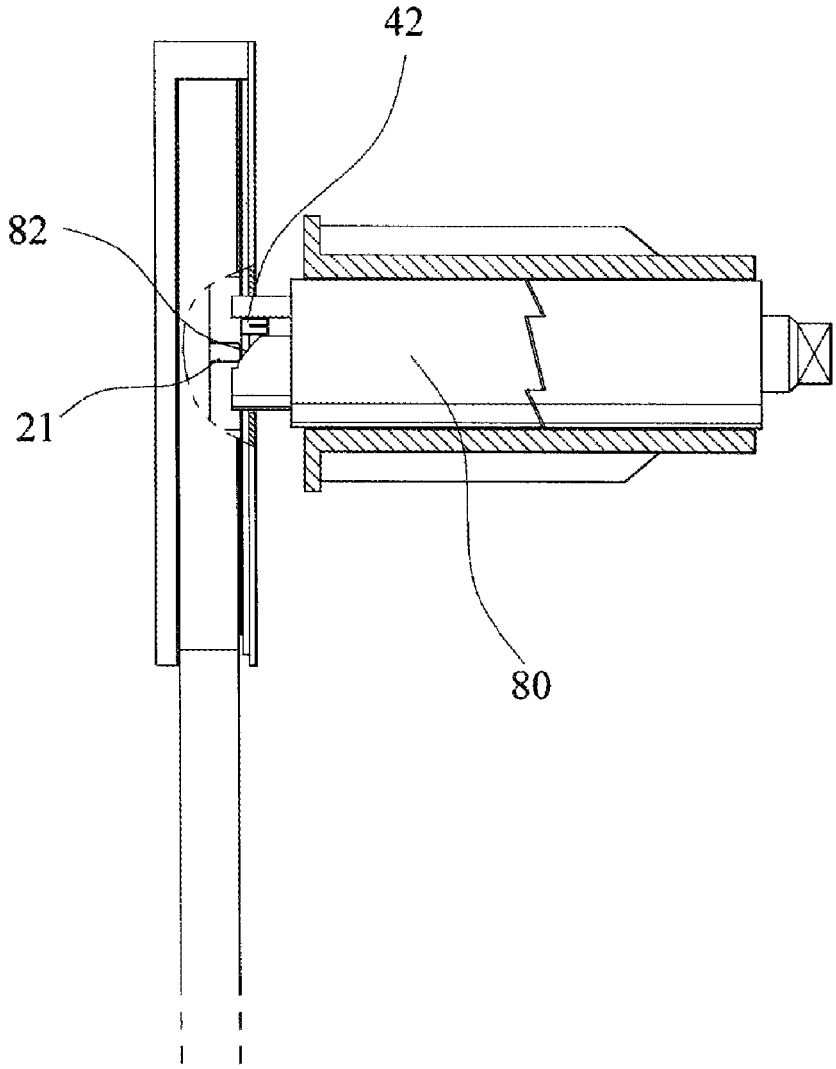
Figure 9:
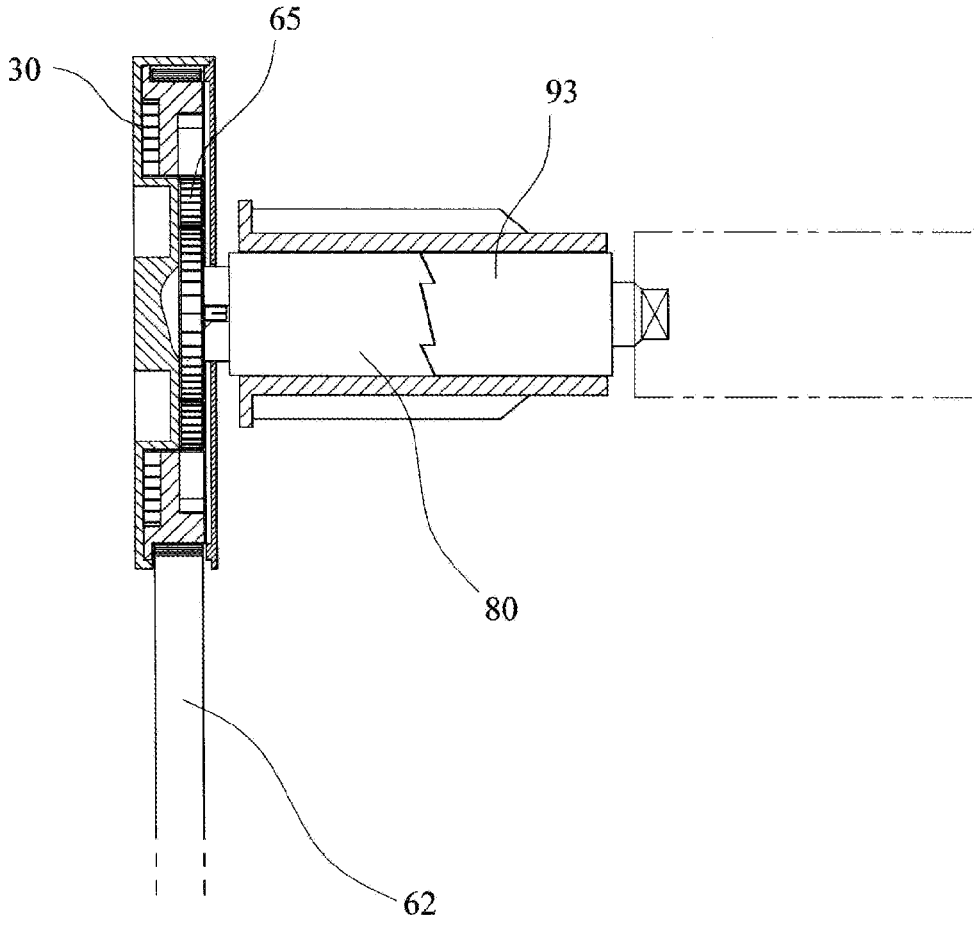
FIGS. 9 to 11 show a using state of the invention.

As shown in FIG. 6, the reinforcement steps 21 of the inner gear 20 are inserted into the connection recesses 83 of the delivery element 80 and the fixing steps 42 of the fixing ring 40 are also inserted into the connection recesses 83. Then, an elastic spring 85 is engaged through the front of the delivery element 80.

The front of the sleeve 90 is provided therein with a pivot element 93 that has teeth 91, which are engaged with the teeth 84 of the delivery element 80, and an insertion opening 92 at its center.

The insertion opening 92 of the pivot element 93 is inserted onto the fixing shaft 13 so that the pivot element 93 is thread-engaged with the threads 84 of the delivery element 80, and then a washer is engaged with the washer recess 17 formed on the end of the fixing shaft 13 for the purpose of fixing.

Figure 1:
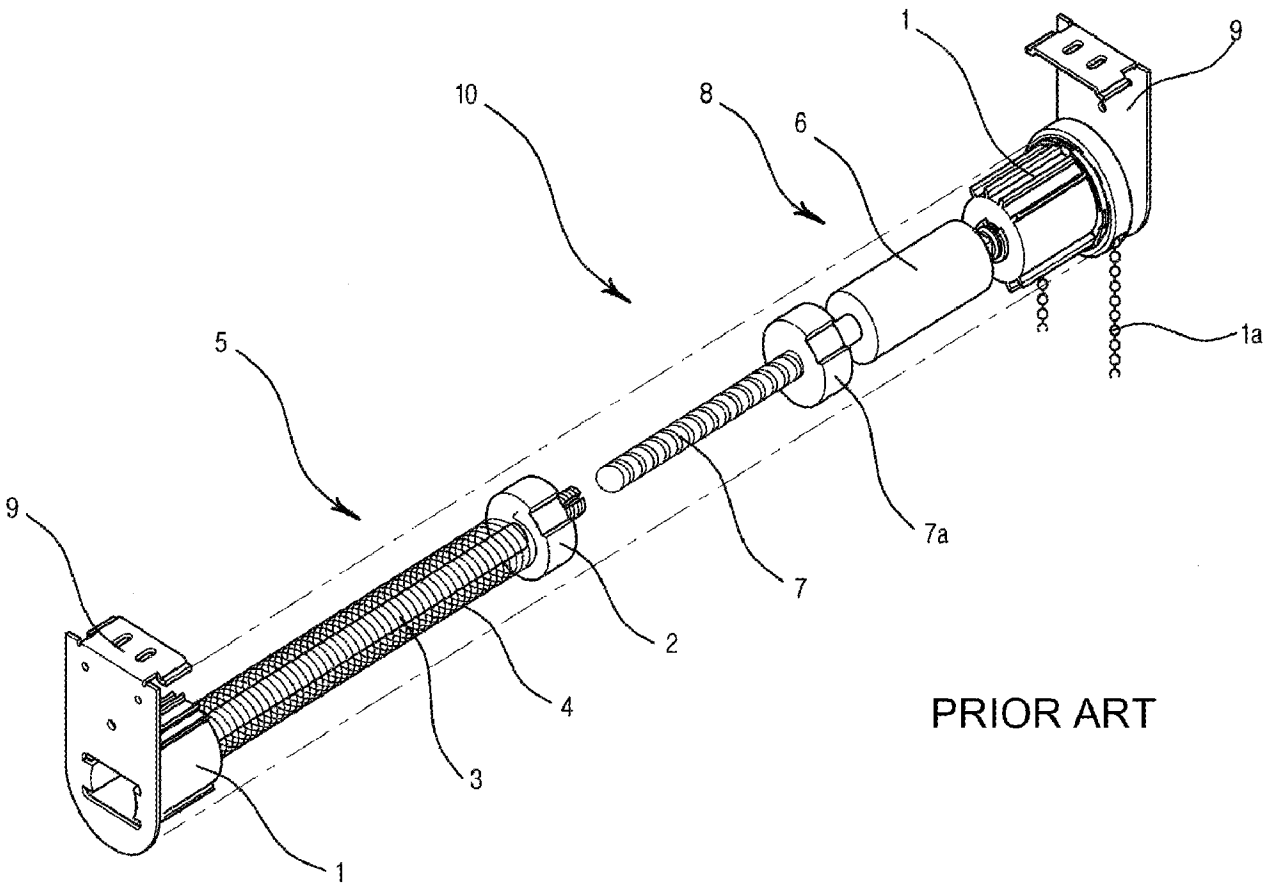
PRIOR ART FIG. 1
FIG. 1 is a perspective view showing the prior art.
Figure 10:
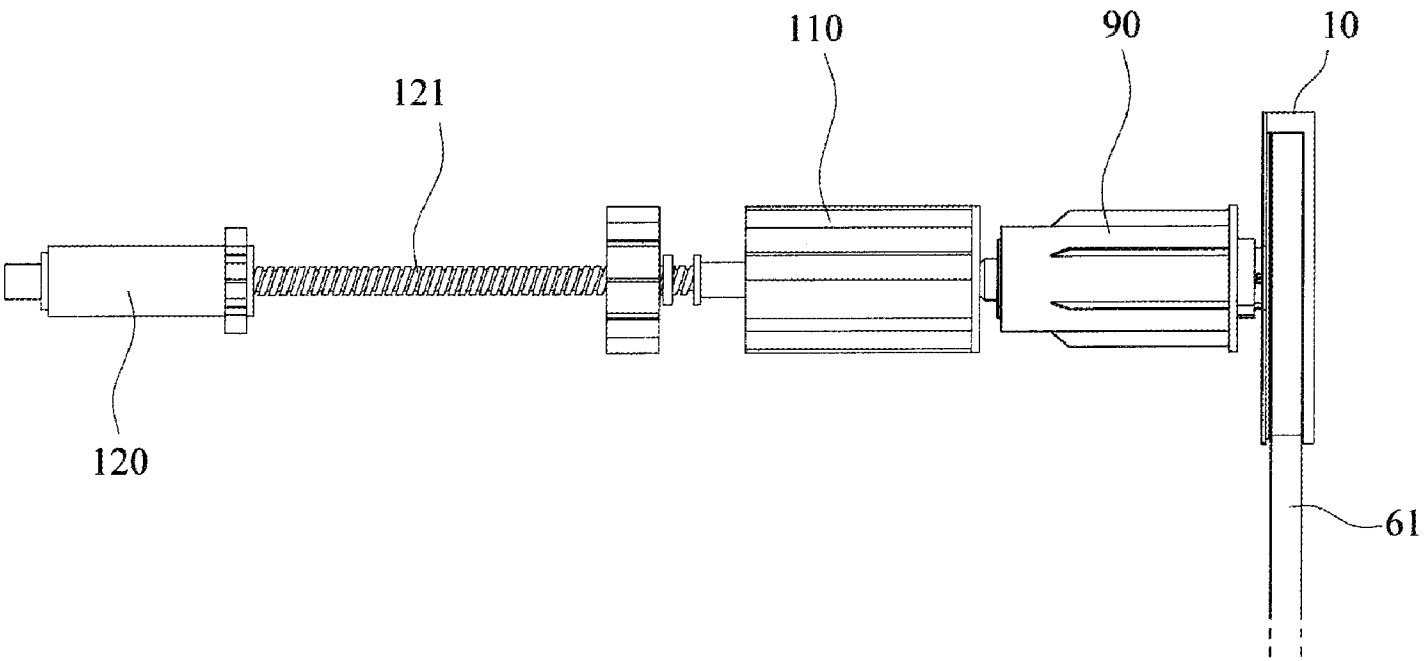

As shown in FIGS. 1 and 10, the conventional blind bracket 9 is engaged from the rear end of the fixing plate 15.

Then, a stopper 110 is mounted from the front of the fixing shaft 13 of the fixing plate 15 and a shaft 121 having a decelerator 120 provided thereto is engaged with the front of the stopper 110.

Further, the pivot body 5 to which the winding pipe 1 having the roll screen wound thereto is mounted is mounted to the opposite bracket 9 and the connection shaft 3 having the pivot element 2 formed at the end thereof is mounted to the front of the pivot body 5. Then, the spring 4 is engaged onto the connection shaft. Then, the roll screen is fixedly mounted onto the winding pipe 1 and the sleeve 90.

Under such state, when the knob 61 of the rotating cord 62 is pulled down so as to move the roll screen downward, as shown in FIGS. 5 to 11, the operation plate 60 is rotated and the rotating gear 65 is also rotated in the same direction.

Also, the small gears 30, which are thread-engaged with the threads 64 formed on the inner surface of the rotating gear 65, are rotated in the same direction. At the same time, the inner gear 20, which is thread-engaged with the small gears 30, is rotated in the opposite direction to the rotating direction of the small gears 30.

Then, the connection recesses 83 of the delivery element 80 contacting the reinforcement steps 21 of the inner gear 20 are rotated, and the fixing steps 42 of the fixing ring 40 are moved up along the inclined surfaces 82 of the delivery element 80, thereby moving the delivery element 80 forward.

At this time, the elastic spring 85 is compressed and the teeth 81 of the delivery element 80 are engaged with the teeth 91 of the pivot element 93 mounted in the sleeve 90, so that the sleeve 90 and thus the stopper 110 provided at the front of the sleeve 90 are also rotated. As a result, the roll screen is moved downward by about 50 cm.

Figure 11:
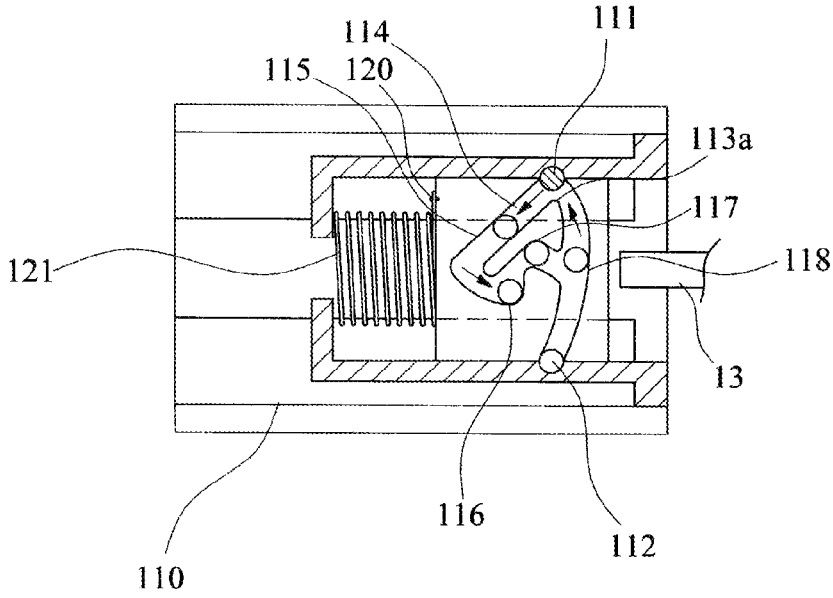

As shown in FIG. 11, while a ball 111 is rotated in a ball recess 112 and is moved into an inclined recess 114 by an upper protrusion 113*a* of a guide step 113, the stopper 110 is rotated. To be more specific, since a center point of the upper protrusion 113*a* is farther formed in the right direction than a center point of a delivery recess 115 formed in the upper side, the ball 111 cannot move in the side direction and moves in the left direction. Then, the ball passes to the inclined recess 114 and is located in an upright recess 116.

When the knob 61 of the rotating cord 62 is stopped, the ball 111 passes to the upright recess 116 and moves to a recessed step 117 at which the ball stays under standby state.

At this time, while the spring 121 fixed with a screw 120 is forward compressed, the friction is increased.

Under such state, the knob 61 is again pulled down, the above processes are repeated, so that the roll screen is again moved downward by about 50 cm. When such operation is repeated several times, it is possible to lower the roll screen to a desired position.

Regarding the sleeve 90 that has moved forward, the ball 111 of the stopper 110 prohibits the sleeve 90 from returning to the original position, so that as the leaf spring 19 is tightened and released, the roll screen is moved down.

When the knob 61 of the rotating cord 62 under stationary state is weakly again pulled down or a user pulls down the roll screen so as to move the roll screen upward, the ball 111 in the stopper 110 passes to the inclined recess 114 and moves to a vertical recess 118. At the same time, as the spring 121 being compressed is released, the operation plate 60 is rotated in the opposite direction and the small gears 30 having outer teeth which mesh with the outer teeth of the rotating gear 65, and inner gear 20 which has outer teeth that also mesh with the outer teeth of the small gears 30 are also rotated, thereby moving the roll screen upward.

At the same time, the opposite pivot body 5 is rotated in the same direction as the sleeve 90 while the compressed spring 4 is released.

At the same time, the opposite pivot body 5 is rotated in the same direction as the cover 90 while the compressed spring 4 is released.

According to the invention, the structure is more simplified, so that the blind can be easily manufactured. Further, the upward and downward operations can be conveniently and easily made.

In addition, since a ball chain is not used, a safety accident can be prevented and the interior design can be made to be neat.

Furthermore, since the roll screen can be moved by the rotating cord and hands, the upward and downward operations can be easily made.

While the invention has been shown and described with reference to certain preferred embodiments thereof, it will be understood by those skilled in the art that various changes in form and details may be made thereto without departing from the spirit and scope of the invention as defined by the appended claims.

What is claimed is:

1. A one cord blind comprising:

a fixing body consisting of a fixing plate that forms a fixing stage on one surface thereof, the fixing stage having a fixing recess with which a leaf spring is engaged, a fixing shaft at its center, which protrudes forward, and a plurality of fixing protrusions around the fixing shaft;

a gear body including an inner gear inserted onto the fixing shaft, which gear symmetrically forms reinforcement steps on its inner surface and has teeth on its outer surface, small gears each of which is inserted onto the respective fixing protrusions and has teeth on its outer surface, the inner gear and the small gears being engaged with each other, and a fixing ring including fixing steps having inner incised grooves, which are symmetrically formed on its exterior surface, locking steps of a spring being engaged with the incised grooves;

an operation plate comprising gear teeth which mesh with teeth on the outer surfaces of the small gears and having a rotating cord wound on its outer periphery, the cord having a knob formed at its lower end, and an annular groove at its front with which a rotating gear having teeth at its inner and outer peripheries is engaged;

an end plate that is mounted at a front surface of the operation plate, has an insertion opening at its center and prevents the gear body and the rotating cord from deviating outward;

a delivery element that is inserted into the insertion opening of the end plate to contact the reinforcement steps of the inner gear and has at its center an insertion opening through which the fixing shaft is inserted, a rear part at which connection notches, each of which has an inclined edge at one side thereof, are formed to be symmetrical, and a front part having teeth; and a sleeve having a pivot element at its inner front, which has teeth, which are engaged with the teeth of the delivery element, and an insertion opening at its center.

* * * * *